8-110 SR
FIP8309 XR 4,217,105

United States Patent [19]
Goodman
[11] 4,217,105
[45] Aug. 12, 1980

[54] PHOTOACTIVATED BLEACH-COMPOSITIONS AND PROCESSES

[75] Inventor: John F. Goodman, Cincinnati, Ohio

[73] Assignee: The Procter & Gamble Company, Cincinnati, Ohio

[21] Appl. No.: 889,067

[22] Filed: Mar. 22, 1978

[30] Foreign Application Priority Data

Mar. 28, 1977 [CA] Canada ..... 274869

[51] Int. Cl.[2] ..... D06L 3/02
[52] U.S. Cl. ..... 8/111; 8/103; 8/107; 8/110; 252/95; 252/99
[58] Field of Search ..... 8/111, 107, 110, 103; 252/95, 99

[56] References Cited

U.S. PATENT DOCUMENTS

| | | | |
|---|---|---|---|
| 3,789,002 | 1/1974 | Weber et al. | 8/111 |
| 3,822,114 | 7/1974 | Montgomery | 8/111 |
| 3,916,652 | 11/1975 | Speakman | 68/13 R |
| 3,927,967 | 12/1975 | Speakman | 8/103 |
| 4,033,718 | 7/1977 | Holcombe et al. | 8/103 |
| 4,094,806 | 6/1978 | Wiers | 8/103 |

FOREIGN PATENT DOCUMENTS

| | | |
|---|---|---|
| 840348 | 10/1976 | Belgium . |
| 1372035 | 10/1974 | United Kingdom . |
| 1408144 | 10/1975 | United Kingdom . |

*Primary Examiner*—A. Lionel Clingman
*Attorney, Agent, or Firm*—William H. Gould; Thomas H. O'Flaherty; Richard C. Witte

[57] ABSTRACT

A process of bleaching cotton fabrics, especially in relation with household laundry, is provided by adsorbing on the fabric sulfonated zinc phthalocyanine photoactivator followed by rinsing and drying of the fabrics in the presence of visible light and oxygen.

13 Claims, No Drawings

PHOTOACTIVATED BLEACH-COMPOSITIONS AND PROCESSES

BACKGROUND OF THE INVENTION

This invention relates to compositions and methods for household laundry operations for combined washing and bleaching of cotton fabrics. Removal of stains from cotton fabrics is thereby accomplished.

Certain published references have disclosed the use of zinc phthalocyanine sulfonates as bleach photoactivators in detergent compositions: U.S. Pat. No. 3,916,652 issued to Speakman on November 4, 1975, hereinafter referred to as Speakman I; U.S. Pat. 3,927,967 issued to Speakman on December 23, 1975, hereinafter referred to as Speakman II; Japanese OPI 50-113,479 laid open to public inspection on Sept. 5, 1975, invented by Holcombe and Schultz, corresponding to USSN 419,320 filed Nov. 27, 1973 and to Canadian application 214,688 filed Nov. 26, 1974; and Japanese OPI 51-135,883, laid open to public inspection on November 25, 1976, invented by Wiers, corresponding to USSN 564,587 filed Apr. 3, 1975 and to Canadian Application No. 248,598 filed Mar. 23, 1976.

Speakman II discloses a number of bleach photoactivators in detergent compositions which contain an alkaline builder salt and preferably a surfactant and a peroxyhydrate. Fabrics treated with these compositions in the presence of visible light and atmospheric oxygen are subjected to a combined washing and bleaching process for household laundry. A preferred photoactivator is zinc phthalocyanine sulfonate used at concentrations of 0.025 to 1.25% by weight of the product composition. Speakman's preferred washing conditions are photoactivator concentrations of 1–150 ppm., temperatures of 80°–160° F., and times of 15 minutes to 5 hours. Speakman specifies exposure of the aqueous laundry baths to visible light, whether outdoors or indoors, whether agitated (e.g. during washing), or unagitated (e.g. during soaking).

Speakman I teaches the practice of the Speakman II process in a washing machine provided with a source of visible light.

The intrinsic color of zinc phthalocyanine sulfonate is blue-green, and when it is present on fabric surfaces they take on this undesirable coloration. This occurs in the absence of light, because in that circumstance the bleach photoactivation process which decolorizes zinc phthalocyanine sulfonate does not take place. Holcombe and Schultz were concerned about this problem, and disclosed certain preferred mixtures of trisulfonated and tetrasulfonated species of zinc phthalocyanine which produced minimum levels of fabric discoloration at equal levels of bleaching. The most highly preferred photoactivator contained no unsulfonated, monosulfonated, or disulfonated zinc phthalocyanine; 6–16 parts trisulfonated; and the balance tetrasulfonated; where the specified parts are determined by an "RDV" method explained in the specification. The washing conditions of Holcombe and Schultz were similar to those of Speakman II, including the specified levels of 0.025–1.25 wt.% photoactivator usage on a product composition basis, except that photoactivator concentrations as low as 0.25 ppm in the laundry baths were disclosed. Certain examples concerned indoor washing of fabrics followed by exposure to the sun for bleaching, as by laying them flat on the ground, especially without rinsing, or by suspending them from an outdoor clothesline.

Wiers was concerned with zinc phthalocyanine tri- and tetra-sulfonates as bleach photoactivators in unbuilt liquid detergent compositions.

Although the blue-green discoloration problem may have been ameliorated by Holcombe and Schultz, it was by no means solved. When their specified levels of zinc phthalocyanine sulfonate are used in practical detergent compositions, effective bleaching occurs when these compositions are used in a washing process of relatively short duration, e.g. 10 to 30 minutes, but blue-green staining occurs when the same compositions are used in a soaking process that may last from one to as much as eighteen hours. Since the detergent manufacturer has no control over how its customers use any given product, and since soaking is a common practice, this is a serious disadvantage. It has now been found that the use of substantially lower amounts of photoactivator give effective photobleaching when used in the laundry soak and do not cause appreciable discoloration. When used in the wash, little bleaching takes place, but no disadvantages occur either. The result is that a manufacturer can deliver to the consumer a product which, when used in the wash, will perform like any other good detergent and, when used in the soak, will deliver bleaching performance as well.

This not only solves the discoloration problem; it also reduces cost by a significant amount, thereby making such a photoactivator-containing product more attractive to manufacturer and consumer alike.

It has also been discovered unexpectedly that the process of soaking need not involve exposure to light; hence it may be carried out for example in a closed washing machine, or in a dark room overnight. This is believed to be because the photoactivator adsorbs on the fabric in a kinetically slow process over the entire soaking period; little desorbs during rinsing because of the slow kinetics; and the remainder is present on the surface of the fabrics where it can effectively participate in a photobleaching process that takes place in the presence of visible light during drying. The presence of photoactivator on the fabrics during drying under visible light is shown to provide a stain removal benefit and may also provide a sanitizing benefit to the fabrics.

SUMMARY OF THE INVENTION

According to the invention there is provided a detergent bleach composition comprising an organic surfactant and a photoactivator wherein the photoactivator is from 0.003% to about 0.025% sulfonated zinc phthalocyanine, by weight of the composition. Also provided is a process of removing oxidizable stains from cotton fabrics which comprises adsorbing photoactivator onto the fabric and drying the fabric in the presence of visible light and oxygen.

DETAILED DESCRIPTION OF THE INVENTION

The essential components of the instant invention are two in number. One is a surfactant which can be anionic, nonionic, semi-polar, ampholytic, or zwitterionic in nature, or can be mixtures thereof. Surfactants can be used at levels from about 10% to about 50% of the composition by weight, preferably at levels from about 15% to about 30% by weight.

Preferred anionic non-soap surfactants are water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate, and beta-alkyloxy alkane sulfonate. Soaps are also preferred anionic surfactants.

Especially preferred alkyl benzene sulfonates have about 9 to about 15 carbon atoms in a linear or branched alkyl chain, more especially about 11 to about 13 carbon atoms. Especially preferred alkyl sulfate has about 8 to about 22 carbon atoms in the alkyl chain, more especially from about 12 to about 18 carbon atoms. Especially preferred alkyl polyethoxy ether sulfate has about 10 to about 18 carbon atoms in the alkyl chain and has an average of about 1 to about 12 $—CH_2CH_2O—$ groups per molecule, especially about 10 to about 16 carbon atoms in the alkyl chain and an average of about 1 to about 6 $—CH_2CH_2O—$ groups per molecule.

Especially preferred paraffin sulfonates are essentially linear and contain from about 8 to about 24 carbon atoms, more especially from about 14 to about 18 carbon atoms. Especially preferred alpha-olefin sulfonate has about 10 to about 24 carbon atoms, more especially about 14 to about 16 carbon atoms; alpha-olefin sulfonates can be made by reaction with sulfur trioxide followed by neutralization under conditions such that any sultones present are hydrolyzed to the corresponding hydroxy alkane sulfonates. Especially preferred alpha-sulfocarboxylates contain from about 6 to about 20 carbon atoms; included herein are not only the salts of alpha-sulfonated fatty acids but also their esters made from alcohols containing about 1 to about 14 carbon atoms.

Especially preferred alkyl glyceryl ether sulfates are ethers of alcohols having about 10 to about 18 carbon atoms, more especially those derived from coconut oil and tallow. Especially preferred alkyl phenol polyethoxy ether sulfate has about 8 to about 12 carbon atoms in the alkyl chain and an average of about 1 to 10 $—CH_2CH_2O—$ groups per molecule. Especially preferred 2-acryloxy-alkane-1-sulfonates contain from about 2 to about 9 carbon atoms in the acyl group and about 9 to about 23 carbon atoms in the alkane moiety. Especially preferred beta-alkyloxy alkane sulfonate contains about 1 to about 3carbon atoms in the alkyl group and about 8 to about 20 carbon atoms in the alkyl moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal, ammonium, or alkanolammonium cations; sodium is preferred. Mixtures of anionic surfactants are contemplated by this invention; a preferred mixture contains alkyl benzene sulfonate having 11 to 13 carbon atoms in the alkyl group and alkyl polyethoxy alcohol sulfate having 10 to 16 carbon atoms in the alkyl group and an average degree of ethoxylation of 1 to 6.

Especially preferred soaps contain about 8 to about 24 carbon atoms, more especially about 12 to about 18 carbon atoms. Soaps can be made by direct saponification of natural fats and oils such as coconut oil, tallow and fish oil, or by the neutralization of free fatty acids obtained from either natural or synthetic sources. The soap cation can be alkali metal, ammonium or alkanolammonium; sodium is preferred.

Preferred nonionic surfactants are water soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1to 30 mols of ethylene oxide with 1 mol of branched or straight chain, primary or secondary aliphatic alcohol having from about 8 to about 22 carbon atoms; more especially 1 to 6 mols of ethylene oxide condensed with 1 mol of straight or branched chain, primary or secondary aliphatic alcohol having from about 10 to about 16 carbon atoms; certain species of polyethoxy alcohols are commercially available from the Shell Chemical Company under the trade name 'Neodol'. Especially preferred polyethoxy alkyl phenols are the condensation product of about 1 to about 30 mols of ethylene oxide with 1 mol of alkyl phenol having a branched or straight chain alkyl group containing about 6to about 12 carbon atoms; certain species of polyethoxy alkyl phenols are commercially available from the GAF Corporation under the trade name 'Igepal'.

Especially preferred polyethoxy polypropoxy glycols are commercially available from BASF-Wyandotte under the trade name 'Pluronic'. Especially preferred condensates of ethylene oxide with the reaction product of propylene oxide and ethylene diamine are commercially available from BASF-Wyandotte under the trade name 'Tetronic'.

Preferred semi-polar surfactants are water soluble amine oxides containing one alkyl moiety of from about 10 to 28carbon atoms and 2 moieties selected from the group consisting of alkyl groups and hydroxyalkyl groups containing from 1to about 3 carbon atoms, and especially alkyl dimethyl amine oxides wherein the alkyl group contains from about 11 to 16 carbon atoms; water soluble phosphine oxide detergents containing one alkyl moiety of about 10 to 28 carbon atoms and 2moieties selected from the group consisting of alkyl groups and hydroxyalkyl groups containing from about 1 to 3 carbon atoms; and water soluble sulfoxide detergents containing one alkyl moiety of from about 10 to 28 carbon atoms and a moiety selected from the group consisting of alkyl and hydroxyalkyl moieties of from 1 to 3 carbon atoms.

Preferred ampholytic surfactants are water soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Preferred zwitterionic surfactants are water soluble derivatives of aliphatic quaternary ammonium, phosphonium and sulfonium cationic compounds in which the aliphatic moieties can be straight chain or branched, and wherein one of the aliphatic substituents contains from about 8 to 18 carbon atoms and one contains an anionic water solubilizing group, especially alkyl-dimethyl-ammonio-propane-sulfonates and alkyl-dimethyl-ammonio-hydroxy-propane-sulfonates wherein the alkyl group in both types contains from about 14 to 18 carbon atoms.

A typical listing of the classes and species of surfactants useful in this invention appear in U.S. Pat. No. 3,664,961 issued to Norris on May 23, 1972 and hereby incorporated herein by reference. This listing, and the foregoing recitation of specific surfactant compounds and mixtures which can be used in the instant compositions, are representative of such materials but are not intended to be limiting.

The other essential component of the instant invention is a photoactivator as described hereinbelow. This component can also be described as a photochemical activator, or as a photosensitizer: these terms are synonymous.

The photoactivator of this invention is comprised of zinc phthalocyanine sulfonate which has been disclosed for this purpose in the four references hereinbefore cited which are hereby incorporated by reference. Preparation of species having varying degrees of sulfonation are described therein as sulfonation reaction products of zinc phthalocyanine and oleum.

Preferred species of zinc phthalocyanine sulfonate are the tri- and tetra-sulfonates, as all species having lower degrees of sulfonation bleach less effectively and stain more. Especially preferred is zinc phthalocyanine tetrasulfonate, which offers good bleaching effectiveness and minimal staining. Practical sulfonations yield mixtures of species; preferred mixtures contain at least about 90% tetrasulfonate and the balance substantially entirely trisulfonate, with no species having a lower degree of sulfonation; especially preferred mixtures contain at least 95% tetrasulfonate and the balance substantially entirely trisulfonate.

Usage of zinc phthalocyanine sulfonate in the compositions of this invention is from about 0.003% to 0.025%, preferably from about 0.006% to about 0.020%, and most preferably from about 0.010% to about 0.016% by weight of the composition.

It is contemplated that for laundry soaking operations a typical product concentration in the soaking bath is 0.6% by weight. This figure is of course under the control of the user, not the detergent manufacturer, so concentrations as low as about 0.3% or as high as about 1.0% can occur. The concentrations of zinc phthalocyanine sulfonate in the laundry bath can accordingly vary from about 0.1 to about 2.5 parts per million (ppm) and are commonly from about 0.4 to about 1.0 ppm.

The foregoing description concerns compositions containing only surfactant and photoactivator, which are the essential elements of this invention. They are unbuilt compositions. Other components are optional, as the photoactivators of this invention are useful in a great variety of otherwise conventional compositions.

For instance, conventional alkaline detergent builders, inorganic or organic, can be used at levels up to about 80% by weight of the composition, i.e. from 0 to about 80%. For built compositions, levels from about 10% to about 60% are preferred, and levels from about 20% to about 40% are especially preferred. The weight ratio of surfactant to total builder in built compositions can be from about 5:1 to about 1:5, preferably from about 2:1 to about 1:2.

Examples of suitable inorganic alkaline detergency builder salts useful in this invention are water soluble alkali metal carbonates, borates, phosphates, polyphosphates, bicarbonates and silicates. Specific examples of such salts are sodium and potassium tetraborates, perborates, bicarbonates, carbonates, tripolyphosphates, pyrophosphates, orthophosphates, and hexametaphosphates.

Examples of suitable organic alkaline detergency builder salts are: (1) Water-soluble aminopolycarboxylates, e.g. sodium and potassium ethylenediaminetetraacetates, nitrilotriacetates and N-(2-hydroxyethyl)-nitrilodiacetates; (2) Water-soluble salts of phytic acid, e.g., sodium and potassiium phytates—See U.S. Pat. No. 2,739,942; (3) Watersoluble polyphosphonates, including specifically, sodium, potassium and lithium salts of ethane-1-hydroxy-1,1-diphosphonic acid; sodium potassium and lithium salts of methylene diphosphonic acid; sodium potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) Water-soluble salts of polycarboxylate polymers and copolymers as described in U.S. Pat. No. 3,308,067.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

In addition, other polycarboxylate builders which can be used satisfactorily include water-soluble salts of mellitic acid, citric acid, pyromellitic acid, benzene pentacarboxylic acid, oxydiacetic acid, carboxymethyloxysuccinic acid and oxydisuccinic acid.

Certain zeolites or aluminosilicates enhance the function of the alkaline metal pyrophosphate and add building capacity in that the aluminosilicates sequester calcium hardness. One such aluminosilicate which is useful in the compositions of the invention is an amorphous water-insoluble hydrated compound of the formula $Na_x(xAlO_2.ySiO_2)$, wherein x is a number from 1.0 to 1.2 and y is 1, said amorphous material being further characterized by a $Mg^{++}$ exchange capacity of from about 50 mg eq. $CaCO_3$/g. to about 150 mg eq. $CaCO_3$/g. and a particle diameter of from about 0.01 microns to about 5 microns. This ion exchange builder is more fully described in patent application 1505/74, invented by B. H. Gedge et al, filed July 16, 1974 in the Republic of Eire and laid open to the public on Jan. 16, 1975, herein incorporated by reference.

A second water-insoluble synthetic aluminosilicate ion exchange material useful herein is crystalline in nature and has the formula $Na_z[AlO_2)_z.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium ion exchange rate on an anhydrous basis of at least about 2 grains/gallon/minute/gram. These synthetic aluminosilicates are more fully described in Belgian Pat. No. 814,874 herein incorporated by reference.

For nominally unbuilt compositions, it is contemplated that compositions can contain minor amounts, i.e. up to about 10% of compounds that, while commonly classified as detergent builders, are used primarily for purposes other than reducing free hardness ions; for example electrolytes used to buffer pH, add ionic strength, control viscosity, prevent gelling, etc.

It is to be understood that the detergent bleach compositions of the present invention can contain other components commonly used in detergent compositions. Soil suspending agents such as water-soluble salts of carboxymethylcellulose, carboxyhydroxymethylcellulose, copolymers of maleic anhydride and vinyl ethers, and polyethylene glycols having a molecular weight of about 400 to 10,000 are common components of the detergent compositions of the present invention and can be used at levels of about 0.5% to about 10% by weight. Dyes, pigments, optical brighteners, and perfumes can be added in varying amounts as desired.

Other materials such as fluorescers, antiseptics, germicides, enzymes in minor amounts, and anti-caking agents such as sodium sulfosuccinate and sodium benzoate may also be added. Other materials useful in detergent compositions are clay, especially the smectite clays disclosed in U.S. Pat. No. 3,915,882, suds boosters, suds depressants, fillers such as sodium sulfate, pH buffers, and hydrotropes such as sodium toluene sulfonate and urea.

Peroxygen bleaches such as sodium perborate can optionally be used in the compositions of this invention; they are however effective only at relatively high temperatures such as approximately 160° F. and above. In conjunction therewith, conventional chemical activators can be used to bleach more effectively at low temperatures, such as the anhydrides, esters and amides disclosed by Gilbert in Detergent Age, June 1967 pages 18–20, July 1967 pages 30–33, and August 1967 pages 26–27 and 67. It is generally believed that these activators function by means of a chemical reaction that requires usage in approximately a 1:1 mol ratio with the peroxygen compound. Catalytic photoactivators for peroxy bleaches can also be used, such as the iron porphines, haemin chlorides and iron phthalocyanines disclosed in copending commonly assigned patent application Ser. No. USSN 697,006 filed June 17, 1976.

It should be understood that, as described in detail hereinbefore, the instant photoactivators do not function by activating perborate or other peroxygen compounds; the mechanism by which the instant photoactivators accomplish their purpose is by activating oxygen.

Granular formulations embodying the compositions of the present invention may be formed by any of the conventional techniques i.e., by slurrying the individual components in water and then atomizing and spray-drying the resultant mixture, or by pan or drum granulation of the components. A preferred method of spray drying compositions in granule form is disclosed in U.S. Pat. Nos. 3,629,951 and 3,629,955 issued to Davis et al on Dec. 28, 1971.

Liquid detergents embodying the photoactivating compositions of the present invention can contain builders or can be unbuilt. If unbuilt, they can contain about 10 to about 50% surfactant, from 1 to about 15% of an organic base such as mono-, di-, or tri-alkanolamine, and a solubilization system containing various mixtures of water, lower alcohols and glycols, and hydrotropes. Built liquid single-phase compositions can contain about 10 to about 25% surfactant, from about 10 to about 20% builder which can be inorganic or organic, about 3 to about 10% hydrotrope, and water. Built liquid compositions in multi-phase heterogeneous form can contain comparable amounts of surfactant and builder together with viscosity modifiers and stabilizers to maintain stable emulsions or suspensions.

The laundry washing process can be carried out under whatever conditions are commonly used in the home: temperatures from about 35° to about 140° F., preferably from about 70° to about 110° F.; and times from about 15 minutes to about 24 hours, preferably from about 1 hour to about 18 hours, more preferably from about 5 hours to about 12 hours. Exposure to light during the soaking process is not necessary, but is permissible and indeed advantageous. Agitation during the soaking process is also not necessary though permissible.

Typically a washing operation follows soaking. This can be done in any conventional manner, using the same or a different detergent composition which may but need not contain zinc phthalocyanine bleach or any other bleach, such as hypochloride or a peroxygen compound. Typically one or more rinses follows the washing operation. The total time of each laundry cycle that fabrics spend in washing and/or rinsing baths is typically from about 10 minutes to about 1 hour, and more commonly from about 20 to about 30 minutes.

Following rinsing, fabrics are dried. According to the process aspects of this invention the fabrics are exposed to visible light during the drying operation. Preferably drying is done outdoors, more preferably in sunlight. Fabrics may be hung on a clothesline or spread out on the ground, according to the usual practice of the person carrying out the laundry operations.

Without wishing to be bound by theory, it may be useful to express the belief that during the soaking process zinc phthalocyanine sulfonate adsorbs onto fabric surfaces at a rate that is kinetically slow. Increased levels of adsorption are progressively found as fabrics are soaked for periods of 15 minutes, 1 hour, 4 hours, and 24 hours. During subsequent washing and/or drying steps desorption takes place, but at the same slow rate. Because the soaking step is ordinarily much longer than the others, a substantial quantity of photoactivated bleach remains present on the fabric surface during the drying operation, and it is here that visible light must be present to initiate the bleaching process. The mechanism whereby irradiation accomplishes this result is explained in Speakman II hereinbefore cited, and in summary is a process wherein zinc phthalocyanine sulfonate upon absorbing light radiation is raised to its triplet state which reacts with triplet atmospheric oxygen to form singlet oxygen, the active bleaching agent capable of decolorizing stains.

Concentrations of zinc phthalocyanine sulfonate in the soaking bath that are higher than the hereinbefore described upper limits are undesirable because they may cause excessive blue-green discoloration and may also reduce bleaching effectiveness. The explanation of these phenomena is believed to lie in the fact that monomeric zinc phthalocyanine species in the soaking bath can dimerize in the laundry soak solution according to an equilibrium reaction that is driven in the direction of increased dimer at high concenrations. When dimer adsorbs on fabric surfaces it forms a multilayer which exaggerates the intrinsic blue-green color of the compound; furthermore upon irradiation with visible light it is the outer layer of zinc phthalocyanine sulfonate that is activated and this layer is not in direct contact with the fabric surface on which the stains are located that the process is intended to bleach.

EXAMPLE I

The stain removal performance of low levels of photoactivator added in a soaking operation was evaluated in conjunction with a granular detergent having the following composition identified herein as Composition [A].

| Component | Wt. % Composition [A] |
|---|---|
| $C_{12}$ branched chain alkyl benzene sulfonate | 20 |
| Sodium tripolyphosphate | 28 |
| Sodium toluene sulfonate | 2 |
| Silicate solids (2.0 ratio $SiO_2/Na_2O$) | 5.4 |
| Sodium sulfate | 34 |
| Sodium carbonate | 0.17 |
| Sodium carboxymethyl cellulose | 0.45 |
| Perfume | 0.1 |
| Optical brightener | [none] |
| Miscellaneous | 1.38 |
| Moisture | 8.5 |
| Total detergent | 100.0 |

Soaking tests were run as follows: to each ½ gal jar was added 1000 ml. of water having a hardness of 9 grains/gallon with a Ca/Mg ratio of 3/1, and 6.0 gm. of detergent composition [A] defined above; the concentration of detergent in the solution was accordingly 0.6%. Photoactivator was added to certain of the solutions, as indicated in Table I. The cloth load in each jar was 143 gm. in weight and consisted of 12 cotton swatches 2½×2½ inches in size, 6 of which had been previously stained with tea and 6 with wine and one clean terry towel to yield a water to cloth ratio of 7:1. [Staining had been accomplished by passing cotton muslin through a boiled tea or wine bath, respectively, followed by squeegeeing, drying and aging. Uniformly, equally stained swatches were selected for testing.] The cloths were soaked in the jars for the time indicated in Table I following which each piece of cloth was rinsed by hand for 30 seconds in 75° F. running water having a hardness of about 9 grains per gallon with a Ca/Mg ratio of 3/1. Following rinsing the cloths were line dried in outdoor sunlight for about 3 hours. After drying, the swatches were read on a Gardner XL-10 Color Difference Meter and the resultant L, a and b values were calculated into whiteness according to the formula $$W=100-\sqrt{(100-L)^2+a^2+b^2}$$

The whiteness values for the swatches are given in Table I

TABLE I

| Stain | TEA | | | |
|---|---|---|---|---|
| Soaking Time | 2 hours | | overnight (18 hours) | |
| Photoactivator in soak solution | 0 ppm | 0.67 ppm | 0 ppm | 0.67 ppm |
| Whiteness Reading* (Avg of 6) | 66.8 | 72.4 | 81.2 | 85.4 |
| Stain | WINE | | | |
| Soaking Time | 2 hours | | overnight (18 hours) | |
| Photoactivator in soak solution | 0 ppm | 0.67 ppm | 0 ppm | 0.67 ppm |
| Whiteness Reading* (Avg. of 6) | 76.9 | 80.3 | 87.4 | 88.1 |

*A difference of 1.44 units is statistically significant at 95% confidence level. A difference of 2 units is barely discernible to an observors eye.

As shown by the data in Table I the presence of a low level of photoactivator in the soak solution followed by rinsing and subsequent irradiation was beneficial in giving improved whiteness readings. For the tea stained swatches the effect of including photoactivator was statistically significant and observable to the eye at both soaking times. For the wine stained swatches, the benefit of the presence of photoactivator was statistically significant and visually observable for the 2-hour soaking time and only directional for the 18 hour soaking time.

Visual observation of the terry cloths included in the fabric load showed no blue staining at the low level of sulfonated zinc phthalocyanine present in the soak solution.

Substantially similar results are obtained when the $C_{12}$ branched chain alkylbenzene sulfonate in Composition [A] is replaced by coconut alkyl sulfate, coconut triethoxy ether sulfate, $C_{14-18}$ paraffin sulfonate, $C_{14-16}$ alpha-olefin sulfonate, nonylphenol tetraethoxy ether sulfate, coconut alpha-sulfocarboxylate, coconut alkyl glyceryl triethoxy ether sulfate, 2 acetoxy-coconut alkane-1-sulfonate, betaethyloxy-coconut alkane sulfonate, coconut soap, tallow soap, ethoxylated coconut alcohol having an average of 9 moles of ethylene oxide per mol of alcohol, ethoxylated nonylphenol having an average of 9 moles of ethylene oxide per mol of alcohol, dimethyldodecylamine oxide, dimethyldodecylphosphine oxide, octadecyl methyl sulfoxide, sodium 3-(dodecylamino)-propionate, sodium 3-(dodecylamino) propane-1-sulfonate, 3-(N,N-dimethyl-N-hexadecylammonio)-2-hydroxypropane-1-sulfonate, 3-(P,P-dimethyl-P-dodecylphosphonio)-propane-1 -sulfonate, and 3-(S-methyl-S-dodecylsulfonio)-propionate.

Substantially similar results are obtained when the sodium tripolyphosphate in Composition [A] is replaced by sodium sulfate, sodium carbonate, potassium carbonate, lithium carbonate, sodium bicarbonate, sodium and potassium ethylenediaminetetraacetates, sodium and potassium nitrilotriacetates, alkali metal borates, alkali metal phosphates, alkali metal pyrophosphates, alkali metal silicates, alkali metal salts of ethane-1-hydroxy-1,1-diphosphonic acid, amorphous water-insoluble hydrated aluminosilicate having the impirical formula $Na(AlO_2.SiO_2)$, and water-insoluble synthetic aluminosilicate having the formula $Na_{12}(AlO_2.SiO_2)_{12}27H_2O$.

EXAMPLE II

The stain removal performance of low levels of photoactivator in a soaking/washing operation was evaluated in conjunction with a granular detergent having the following composition identified herein as Composition [B].

| Component | Wt. % Composition [B] |
|---|---|
| $C_{12}$ branched chain alkyl benzene sulfonate | 20 |
| Sodium toluene sulfonate | 2 |
| Sodium tripolyphosphate | 33 |
| Silicate Solids (2.0 ratio $SiO_2/Na_2O$) | 5.4 |
| Sodium Sulfate | 28 |
| Enzyme | |
| Protease (activity at 1.5 Anson Units/gram) | 0.45 |
| Amylase (activity equal to 19,750 Maltose Units) | 0.05 |
| Perfume | 0.15 |
| Miscellaneous | 2.2 |
| Fabric Whitening Agent | 0.25 |
| Moisture | 8.5 |

Control Composition [B] was compared against a similar composition which contained 0.011% photoactivator which corresponds to 0.67 ppm photoactivator in an aqueous solution containing 0.6 wt.% of granular product.

Naturally soiled fabrics along with laboratory stained fabrics were soaked, washed, rinsed, sun dried and evaluated for stain removal and whiteness maintenance by a panel of 3 expert judges who were not familiar with the test details. The naturally soiled fabrics were split so that one section would be soaked, etc. in the control composition and the second section would be soaked, etc. in the composition which included the photoactivator. The judges used a 0–4 point scale in evaluating the fabrics in a side-by-side comparison (0=no difference; 4=one is a whole lot cleaner, whiter, etc.). Test details were as follows:

| | |
|---|---|
| Soak | |
| Place | In the washing machine |
| Product Concentration % | 0.6% |
| Water/cloth ratio | 7/1 |
| Water hardness and temp. | 9 grain/gal.; 22° C. |
| Soaking time | 16 hours |
| Wash | |
| Place | In the washing machine |
| Product concentration % | 0.17 |
| Water/cloth ratio | 25/1 |
| Water hardness and temp. | 9 grain/gal.; 22° C. |
| Time | 20 minutes |
| Rinse | |
| Place | In the washing machine |
| Water hardness and temp. | 9 grain/gal.; 22° C. |
| Time | 10 minutes |
| Dry | Line dry in the sun - 3 hours. |

The numbers assigned for each fabric by the panelists were combined and averaged. The results were then tested for statistical significance. In Table II below, the number shown, if positive, indicates an advantage for Composition [B] +0.011% photoactivator. A negative number indicates an advantage for Composition [B] without photoactivator. It should be noted that the side-by-side fabric comparisons were made under visible light wherein the U.V. component had been filtered out.

TABLE II

| Fabric | Average Panel Score: Soil Removal | Whiteness Maintenance | Stain Removal |
|---|---|---|---|
| Naturally soiled fabrics | | | |
| Shirts-polyester/cotton | −0.24 | +0.08 | — |

TABLE II-continued

| Fabric | Average Panel Score: Soil Removal | Whiteness Maintenance | Stain Removal |
|---|---|---|---|
| -cotton only | +0.24 | +1.40* | — |
| T-shirts | +0.40(1) | +1.00 | — |
| Bath towels | +0.16 | +0.40(1) | |
| Stained fabrics | | | |
| Polyester-wine stain | | | +0.08 |
| Terry (cotton)-wine stain | | | +3.00* |
| Cotton (poplin) | | | |
| Grape juice stain | | | +0.32 |
| Terry (cotton) | | | |
| Grape juice stain | | | +2.32* |
| Cotton-Tea stain | | | +2.24* |
| Terry-Tea stain | | | +2.82* |
| Cotton-Coffee stain | | | +0.82* |
| Terry-Coffee stain | | | +1.32 |
| Cotton-Chocolate stain | | | +1.50 |
| Polyester-blood stain | | | −0.50 |
| Cotton-blood stain | | | +0.82(1) |

*statistically significant at 95% confidence
(1)statistically significant at 80% confidence As shown by the data in Table II the advantage of including photoactivator during the soaking operation is clearly seen for cotton fabrics which are soiled or stained with oxidizable stains. No advantage was expected for the polyester fabrics since the photoactivator does not deposit on polyester.

No blue staining of fabrics due to the presence of photoactivator was noted.

What is claimed is:

1. A detergent bleach composition comprising an organic surfactant and a photoactivator wherein the photoactivator is from about 0.003% to about 0.020% sulfonated zinc phthalocyanine by weight of the composition.

2. A detergent bleach composition according to claim 1 wherein the photoactivator is zinc phthalocyanine trisulfonate or zinc phthalocyanine tetrasulfonate or a mixture thereof, and wherein the photoactivator is from about 0.006% to about 0.020% by weight of the composition.

3. A detergent bleach composition according to claim 2 wherein the photoactivator is comprised of at least about 90% zinc phthalocyanine tetrasulfonate and the balance is substantially entirely zinc phthalocyanine trisulfonate; and wherein the photoactivator is from about 0.010% to about 0.016% by weight of the composition.

4. A detergent bleach composition according to claim 2 wherein the organic surfactant is from about 10% to about 50% by weight of the composition and is an anionic, nonionic, semi-polar, ampholytic, or zwitterionic surfactant; and wherein said composition additionally contains from about 10% to about 60% by weight of the composition of alkaline detergent builder.

5. A detergent bleach composition according to claim 3 wherein the organic surfactant is from about 15% to about 30% by weight of the composition and is selected from the group consisting of water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate, beta-alkyloxy alkane sulfonate, soap; water soluble compounds produced by the condensation of ethylene oxide with an alcohol, alkyl phenol, polypropoxy glycol or polypropoxy ethylene diamine; water soluble amine oxides, phosphine oxides, and sulfoxides; water soluble derivatives of aliphatic secondary and tertiary amines; and water soluble derivatives of aliphatic quaternary ammonium, phosphonium, and sulfonium cationic compounds; and wherein said composition additionally contains from about 10% to about 60% of an alkaline detergent builder selected from the group consisting of aluminosilicates; water soluble alkali metal carbonates, borates, phosphates, polyphosphates, bicarbonates and silicates; and water soluble aminopolycarboxylates, phytates, polyphosphonates, and polycarboxylates.

6. A process for removing stains from cotton fabrics which comprises step (a): treating the fabrics with an aqueous solution of the detergent bleach composition of claim 5, wherein the concentration of photoactivator in the solution is from about 0.4 to about 0.67 parts per million; wherein the organic surfactant is from about 15% to about 30% by weight of the composition and is selected from the group consisting of water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate, beta-alkyloxy alkane sulfonate, soap; water soluble compounds produced by condensation of ethylene oxide with an alcohol, alkyl phenol, polyproxy glycol or polyproxy ethylene diamine; water soluble amine oxides, phosphine oxides, and sulfoxides; water soluble derivatives of aliphatic secondary and tertiary amines; and water soluble derivatives of aliphatic quaternary ammonium, phosphonium, and sulfonium cationic compounds; and wherein said composition additionally contains from about 10% to about 60% of an alkaline detergent builder selected from the group consisting of aluminosilicates; water soluble alkali metal carbonates, borates, phosphates, polyphosphates, bicarbonates and silicates; and water soluble aminopolycarboxylates, phytates, polyphosphonates, and polycarboxylates; and step (b): drying the fabrics in the presence of visible light and oxygen; wherein step (a) is carried out at a temperature from about 35° F. to about 140° F. for a period of time from about 15 minutes to about 24 hours.

7. The process of claim 6 for removing stains from cotton fabrics wherein step (a) is carried out at a temperature from about 70° F. to about 110° F. for a period of time from about 5 hours to about 12 hours.

8. A detergent bleach composition according to claim 1 wherein said composition additionally contains peroxygen bleach.

9. A detergent bleach composition according to claim 5 wherein said composition additionally contains sodium perborate.

10. A process for removing stains from cotton fabrics which comprises treating the fabrics with an aqueous solution of the detergent bleach composition of claim 2, wherein the concentration of photoactivator in the solution is from about 0.1 to about 0.67 parts per million; and drying the fabrics in the presence of visible light and oxygen.

11. A process for removing stains from cotton fabrics which comprises step (a): treating the fabrics with an aqueous solution of the detergent bleach composition of claim 5, wherein the concentration of photoactivator in the solution is from about 0.4 to about 0.67 parts per million; wherein the organic surfactant is from about 15% to about 30% by weight of the composition and is selected from the group consisting of water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate, beta-alkyloxy alkane sulfonate, soap; water soluble compounds produced by condensation of ethylene oxide with an alcohol, alkyl phenol, polyproxy glycol or polyproxy ethylene diamine; water soluble amine oxides, phosphine oxides, and sulfoxides; water soluble derivatives of aliphatic secondary and tertiary amines; and water soluble derivatives of aliphatic quaternary ammonium, phosphonium, and sulfonium cationic compounds; and wherein said composition additionally contains from about 10% to about 60% of an alkaline detergent builder selected from the group consisting of aluminosilicates; water soluble alkali metal carbonates, borates, phosphates, polyphosphates, bicarbonates and silicates; and water soluble aminopolycarboxylates, phytates, polyphosphonates, and polycarboxylates; and step (b): drying the fabrics in the presence of visible light and oxygen; wherein step (a) is carried out at a temperature from about 35° F. to about 140° F. for a period of time from about 15 minutes to about 24 hours.

12. A process for removing stains from cotton fabrics which comprises treating the fabrics in the absence of light with an aqueous solution of the detergent bleach composition of claim 2, and drying the fabrics in the presence of visible light and oxygen.

13. A process for removing stains from cotton fabrics which comprises treating the fabrics in the absence of light with an aqueous solution of the detergent bleach composition of claim 2, wherein the concentration of photoactivator in the solution is from about 0.1 to about 1.0 parts per million; and drying the fabrics in the presence of visible light and oxygen.

* * * * *